United States Patent [19]

Fox

[11] 4,019,592

[45] Apr. 26, 1977

[54] BY-PASS TOOL

[75] Inventor: Fred K. Fox, Houston, Tex.

[73] Assignee: Engineering Enterprises, Inc., Houston, Tex.

[22] Filed: Dec. 31, 1975

[21] Appl. No.: 645,799

[52] U.S. Cl. ..... 175/234; 166/334; 175/107; 175/321

[51] Int. Cl.[2] ..... E21B 17/00; E21B 3/12

[58] Field of Search ..... 175/234, 317, 321, 107, 175/100; 166/226; 173/78, 58, 80, 64

[56] References Cited

UNITED STATES PATENTS

| | | | |
|---|---|---|---|
| 2,591,488 | 4/1952 | Yost | 175/107 |
| 2,865,602 | 12/1958 | Whittle | 175/107 |
| 3,059,619 | 10/1962 | Beaumont | 173/64 |
| 3,329,221 | 7/1967 | Walker | 175/321 |
| 3,497,009 | 2/1970 | Harrington | 175/321 |
| 3,504,936 | 4/1970 | Brown et al. | 175/321 |
| 3,656,565 | 4/1972 | Fox | 175/323 |

*Primary Examiner*—James A. Leppink
*Attorney, Agent, or Firm*—W. F. Hyer; Marvin B. Eickenroht

[57] ABSTRACT

There is disclosed a tool which is connectible as part of a drill string and which is adapted, upon lifting of the drill string, to permit drilling fluid therein to by-pass a motor in the lower end of the string below the tool.

5 Claims, 8 Drawing Figures

BY-PASS TOOL

This invention relates to a tool of the type which is connectible as part of a pipe string for use in permitting fluid therein to by-pass the portion of the pipe string below such tool.

In one of its aspects, this invention relates to an improved tool of this type which is particularly well suited for bypassing a motor which is operated by the circulation of drilling fluid therethrough. By way of example, the motor may comprise the turbine section of a turbodrill for use in rotating a bit at the lower end of the drill string, or it may comprise the turbine section of an annular mud pump for use in rotating helical blades within the annulus of a well, as shown in U.S. Pat. No. 3,656,565.

There are occasions in which drilling fluid is circulated downwardly through the drill string, and thus any such motor at the lower end thereof, even though the bit is not drilling hole. For example, this may occur as the density of the drilling mud is being increased, as cuttings are being circulated upwardly within the annulus for inspection at ground level or for cleaing out the hole, and when lost circulation material is being introduced into the hole. Since there is no load on the bit, and thus none on the motor even though the motor is running at full speed and under maximum hydraulic load, there may be considerable wear on the bearings, seals and other working parts of the motor, and thus frequent need to pull the string in order to replace the motor.

Whittle U.S. Pat. No. 2,865,602 shows a tool which is connected as a part of the drill string and which comprises telescopically arranged tubular members which are vertically and sealably reciprocable relatively with respect to one another between an extended position, as the drill string is raised and lowered within the well bore, and contracted position, when the bit on the lower end of the string is in drilling position at the lower end of the well bore. More particularly, the tubular members are provided with a valve means which, when the members are retracted, is closed to confine all of the drilling fluid for flow through a turbine section in the drill string, and, when the members are extended is opened to permit drilling fluid to bypass the turbine section in flowing out the lower end of the bit into the annulus about the string.

As in other well tools comprising telescopically arranged tubular members which are sealed with respect to one another during reciprocation, the tubular members are urged to extended position by a force due to high pressure drilling fluid within the tool acting over a cross-sectional area of a portion of the inner member. Thus, the valve means is open as the drill string is raised and lowered within the well bore. However, when it is desired to resume drilling operations, downward force must be applied to the drill string in order to overcome this pump out effect and thus maintain the bypass in closed position. The force required for this purpose may be so great as to make it impossible to start rotation of the bit.

It is therefore the primary object of the present invention to provide a by-pass tool of the type described which may be closed with little or no downward force.

Another object is to provide such a tool which is of relatively simple and inexpensive construction.

These and other objects are accomplished, in accordance with the illustrated embodiment of the present invention, by a tool of this type comprising a pair of tubular members which, in addition to being longitudinally reciprocable with respect to one another between extended and retracted positions, are arranged concentrically of one another to provide an annular space between them. The outer member has a first seal means carried thereon which sealably engages the inner member, when the drill string is lowered to move the members to retracted position, and the inner member has a seal means carried thereon which sealably engages the outer member to define a first annular chamber within the space between the members, and a third seal means is provided for sealably engaging between the inner and outer members to provide a second annular chamber in such space when the members are moved to retracted positions. A port in the outer member connects the second chamber with the exterior of the tool, and an opening in the inner member connects the interior thereof with the second chamber when the upper end of the drill string is raised to move the members to extended position, whereby drilling fluid within the tool may pass into and through the second chamber and out the port in the outer member, thereby bypassing the portion of the drill string below it. In the illustrated and preferred embodiment of the invention, the third seal means is carried by the outer member for sealably engaging about the inner member as the latter is lowered into retracted position.

A port in the inner member connects the first chamber with the interior of the tool, so that high pressure drilling fluid acts over the seal means on this inner member to urge it toward retracted position. This at least partially balances the "pump out" effect, whereby the tool may be held in retracted position, and thus with the bypass closed, with less force on the drill string than heretofore required. Preferably, the tool is of such construction that the volume of the first chamber increases and decreases, during reciprocation of the members, in an amount substantially equal to the decrease and increase, respectively, of the volume of the remainder of the interior of the tool. Thus the tool is substantially pressure balanced in the sense that the retracting force is substantially equal to the extending force or pump out effect thereon, whereby little or no downward force must be imposed on the drill string to close the by-pass. In the case of a tool in which, as illustrated, the portions of the tubular members with which the seal means are sealably engaged, are right cylindrical surfaces, the effective cross-sectional area of the inner member within the first chamber is substantially equal to the portion of the inner member with which the third seal means is slidably engageable.

In the illustrated embodiment of the invention, the opening in the inner member is its open end so as to connect the interior thereof with the second chamber when such end is removed from sealably sliding relation within the second seal means carried by the outer member. In this way, the members can be moved between retracted and extended positions within a tool of minimum longitudinal dimensions.

In the drawings, wherein like reference characters are used throughout to designate like parts:

Figure 1A:
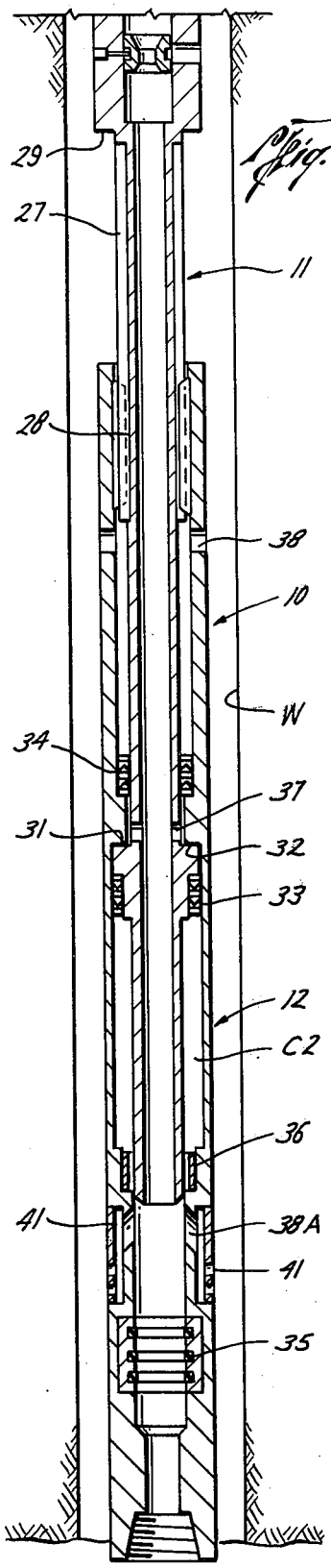
FIG. 1A is a vertical sectional view of a by-pass tool constructed in accordance with the present invention and connected as part of a drill string disposed within a well bore, the tubular members of such tool being shown in extended position to open the by-pass thereof.
Figure 2:
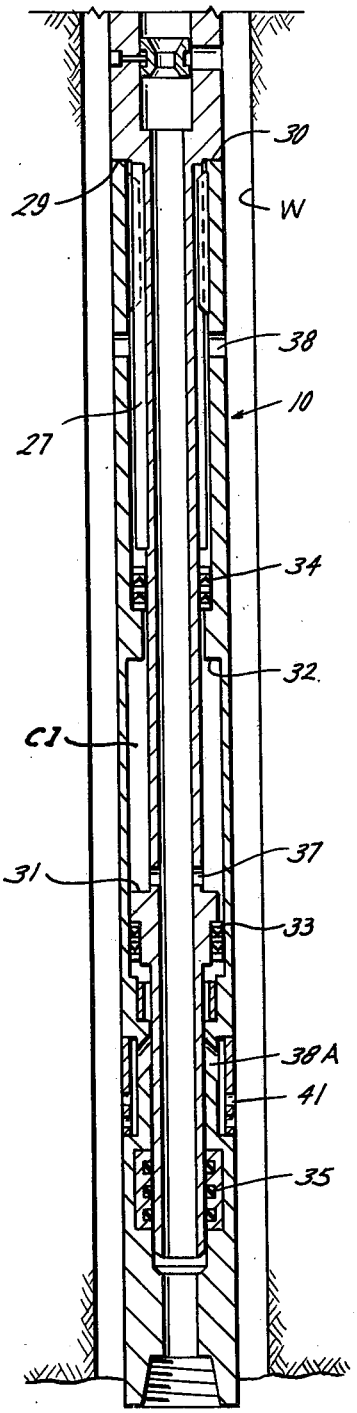
FIG. 2 is a vertical sectional view of the by-pass tool, similar to FIG. 1A, but with the tubular members thereof moved to retracted position to close the by-pass.
Figure 3A:
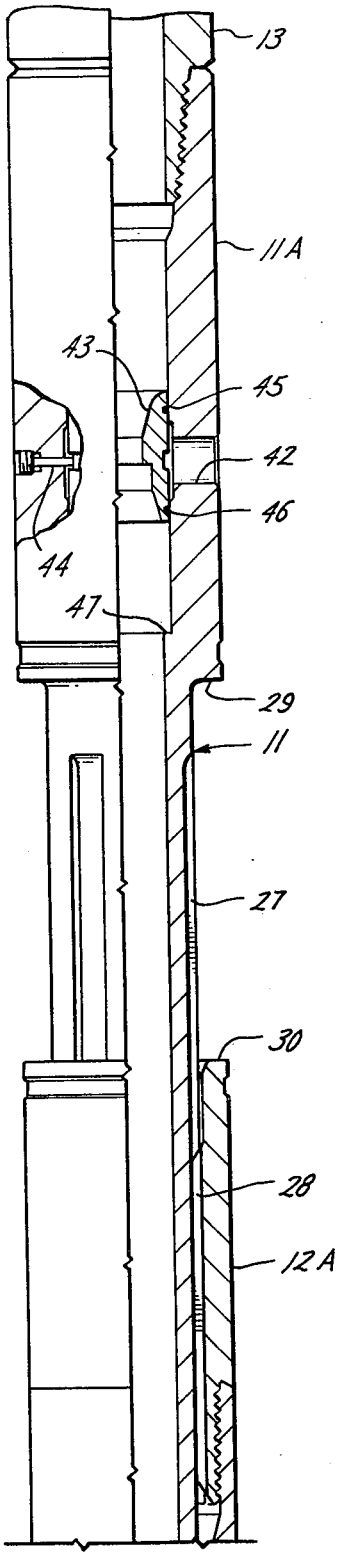
Figure 3B:
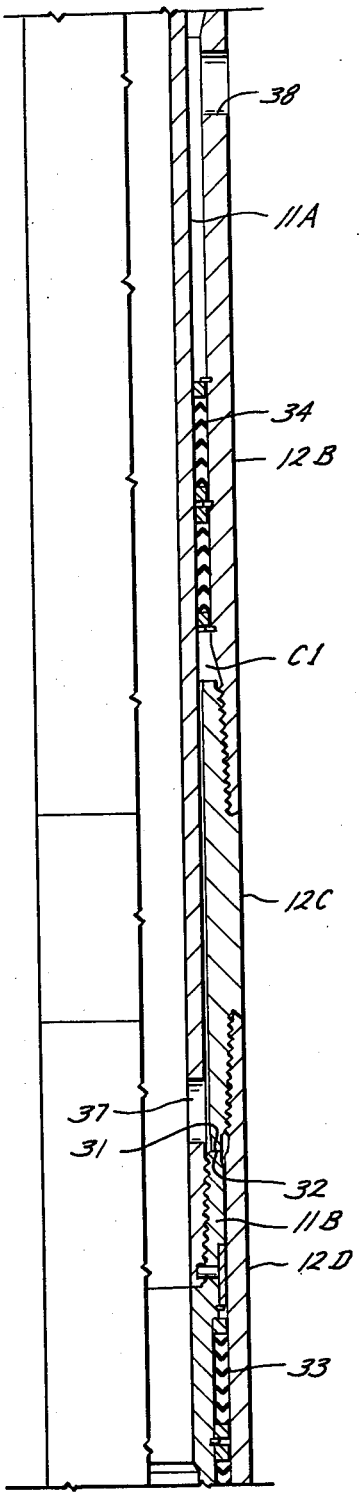
Figure 3C:
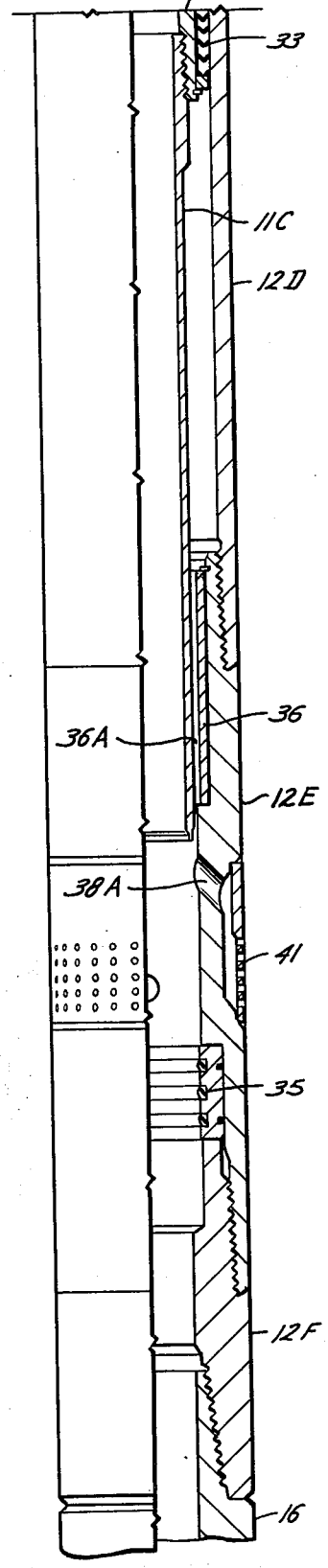
Figure 4A:
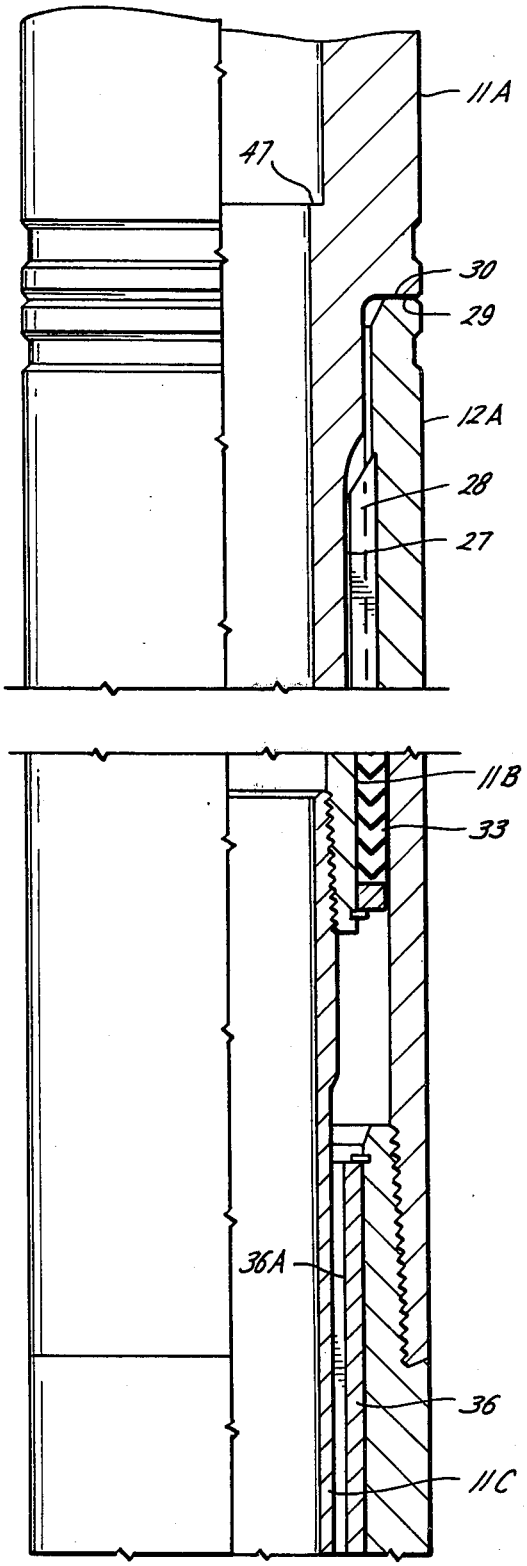
Figure 4B:
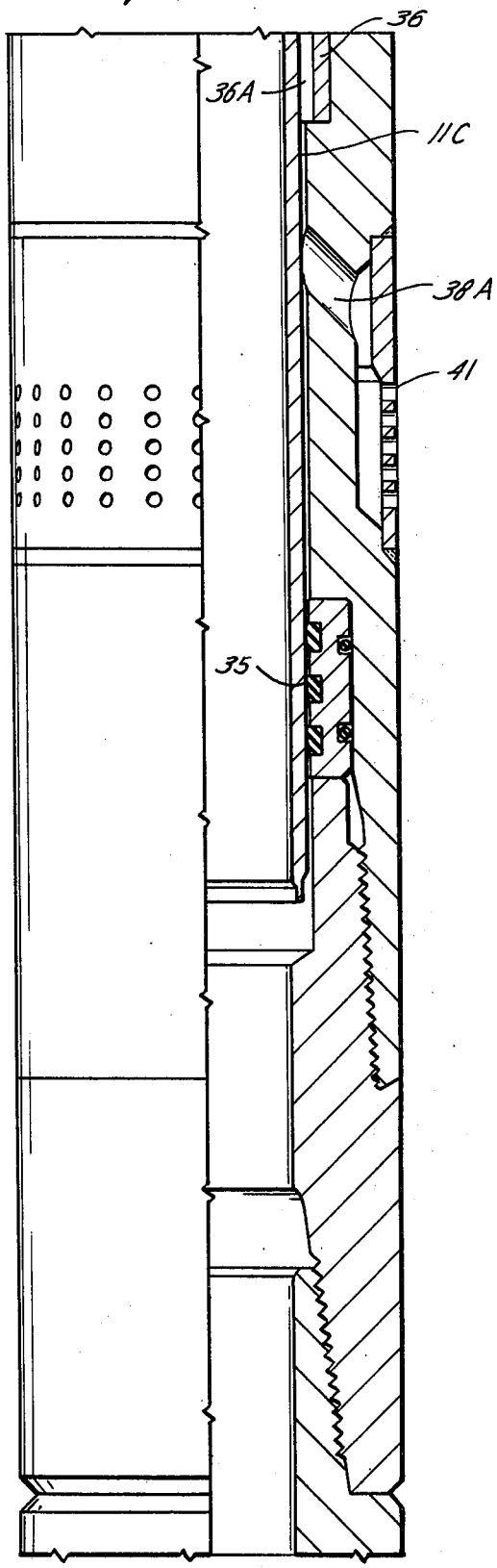

FIGS. 3A, 3B and 3C are enlarged views, partly in elevation and partly in section, of the upper, intermediate and lower portions respectively, of the by-pass tool, with the tubular members thereof shown in the by-pass opening position of FIG. 1A; and FIGS. 4A and 4B are additional and further enlarged views of portions of the by-pass tool, partly in elevation and partly in section, FIG. 4A being vertically discontinuous for purposes of illustration, and the tubular members thereof being shown in the by-pass closing position of FIG. 2.

Figure 1B:
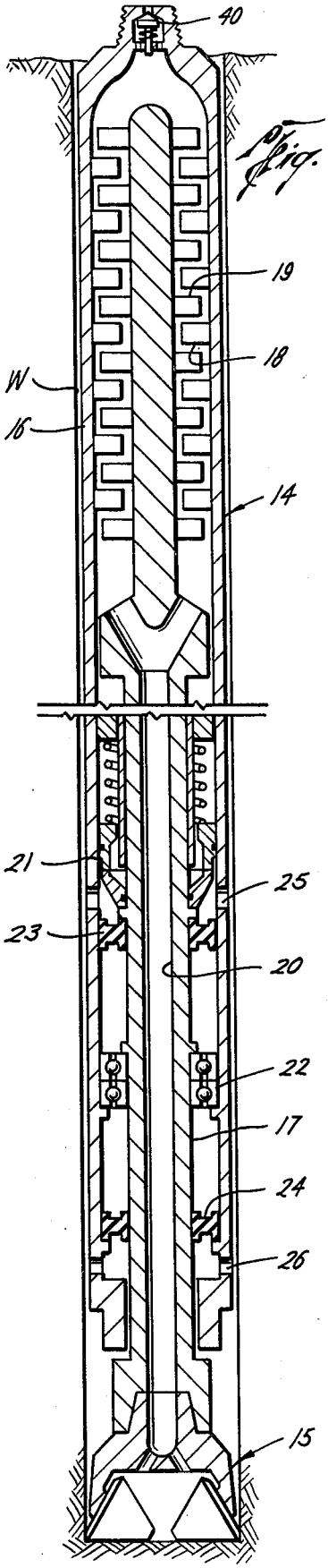
FIG. 1B is a vertical sectional view of a turbine type motor which is connected as part of the drill string beneath the by-pass tool of FIG. 1 and above the bit on the lower end of the string.

With reference now to the details of the above-described drawings, the by-pass tool, which is indicated in its entirety by reference character 10, comprises telescopically arranged inner and outer tubular members 11 and 12, respectively, which are longitudinally and sealably reciprocable with respect to one another between the extended, by-pass opening position of FIGS. 1A, 3A, 3B and 3C, and the retracted, by-pass closing position of FIGS. 2, 4A and 4B. The upper end of inner tubular member 11 is suspended from the lower end of drill string member 13 (see FIG. 3A), and the lower end of tubular member 12 is connected to the upper end of a turbine motor 14 of a turbodrill. Thus, the lower end of the motor is in turn connected to a bit 15 (see FIG. 1B), which, with the drill string lowered within a well bore W, as shown in FIGs. 1A, 1B and 2, rests on the lower end thereof.

The turbine motor 14 includes an outer case or housing 16 having a pin at its upper end for threaded connection with a box at the lower end of tubular member 12 of the by-pass tool, and a shaft 17 arranged concentrically within the housing and having a box at its lower end for threaded connection with a pin on the bit 15. The upper end of the shaft 17 is spaced from the housing 16 to provide an annular passageway which is open at its upper and lower ends, whereby drilling fluid passing downwardly through the drill string and by-pass tool is caused to circulate therethrough. Turbine blades 18 mounted on the inner diameter of the case and turbine blades 19 mounted on the shaft 17 are arranged in conventional fashion within the passageway for causing the shaft to rotate within the housing in response to the passage of drilling fluid downwardly therethrough.

This, of course, causes bit 15 at the lower end of the shaft to rotate with respect to the drill string so that, when the drill string is lowered to move the tubular members 11 and 12 to retracted positions, a downward load may be applied to the bit in order to deepen the well bore. During the drilling operation, drilling fluid passes from the turbine section into a central passageway 20 in the lower end of the shaft which connects with ports at its lower end leading to the bit 15. As is well known in this art, upon passing through the bit, the drilling fluid flows upwardly within the annulus between the drill string and well bore W for return to the surface level.

Due to the pressure drop across the bit and the motor, the pressure of the drilling fluid within the drill string is much higher than that externally thereof. As previously noted, it is this pressure differential which creates a force urging the tubular members 11 and 12 of by-pass tool 10 to extended positions. As also previously mentioned, in the absence of the present invention, this force would have to be overcome in moving the members to retracted position in order to close the by-pass while loading the bit.

A seal means 21 in the annular space between the lower end of the shaft and the housing, which, as shown in FIG. 1B, may be a typical face type seal, diverts drilling fluid passing through turbine blades 18 and 19 into the central passageway 20 of shaft 17. Shaft 17 is supported for rotation within the housing by means of bearings 22 within the annular space beneath seal means 21. The bearings are contained within a lubricant which is confined at its upper and lower ends by means of seal rings 23 and 24, respectively, which are vertically slidable within the annular space so as to compensate for pressure changes therein. An upper port 25 in the housing connects the annular space with the exterior of the tool between seal means 21 and 23, and a lower port 26 therein connects the annular space with the exterior of the tool beneath the seal means 24. In this way, fluid pressure above and below the seal rings 23 and 24 is substantially equal, and the pressure differential between the interior and exterior of the turbine motor 14 is taken across the seal means 21.

It will be understood that although the by-pass tool 10, which is to be described in detail to follow, is especially useful in connection with turbine motor 14, it may also be useful in connection with downhole motors of other construction, or for that matter, in connection with other tools or parts connected as a part of the drill string.

An upper portion of tubular member 11 of by-pass tool 10 has a vertical spline 27 which cooperates with vertical spline 28 on an upper portion of the inner diameter of outer tubular member 12 to prevent relative rotation between the members. The members are located in retracted position by the landing of a shoulder 29 about the enlarged upper end of inner tubular member 11 on the upper end 30 of outer tubular member 12. On the other hand, the members are located in extended position by the engagement of an upwardly facing shoulder 31 about an outwardly enlarged intermediate portion of member 11 with a downwardly facing shoulder 12 about an inwardly enlarged intermediate portion of the inner diameter of member 12. With bit 15 resting on the bottom of well bore W, the drill string may be raised so as to lift inner member 11 to extended position, or lowered to lower the inner member to retracted position. During raising or lowering of the drill string, the members are in extended position of FIG. 1A.

A seal means 33 is carried by the inner member 11, beneath the outwardly enlarged portion thereof on which the shoulder 31 is formed for sealably engaging the portion of the inner diameter portion of tubular member 12 between the inwardly enlarged portion thereof on which shoulder 32 is formed and another inwardly enlarged portion thereof near its lower end. A first or upper seal means 34 is carried by the outer member 12 just above the upper enlarged portion thereon for sealably engaging the outer diameter of the inner member 11 along the length thereof intermediate shoulder 31 and spline 27. A second or lower seal means 35 is carried on the lower enlarged portion of the outer member 12 for sealably engaging the lower portion of tubular member 11 when the members are in retracted position, as shown in FIG. 2.

Seal means 33 and 34 define the upper and lower ends of a first or upper annular chamber C-1 within the annular space between inner and outer members, and seal means 33 and 35 define the upper and lower ends of a second or lower annular chamber C-2 within such annular space, when the member 11 is lowered to its retracted position with respect to member 12. A port 37 in inner member 11 connects chamber C-1 with the interior of the inner member, and thus with high pressure drilling fluid within the tool; and a port 38A in the outer member 12 connects the lower second chamber C-2 with the exterior of the tool, and thus with low pressure drilling fluid in the annulus of the well bore W. Another port 38 in outer member 12 vents the annular space between the members and above seal means 34 to the exterior of the tool so as to insure free circulation beneath splines 27 and 28 during reciprocation of the members.

When the drill string is raised to lift the lower end of member 11 to the extended position of FIG. 2, the open lower end of member 11 is removed from and raised above said seal means 35, so that high pressure drilling fluid within the by-pass tool is free to pass into and through chamber C-2 and out port 38A to the exterior of the tool. In this way, there is insufficient drilling fluid passage through the turbines to cause the motor to be damaged by rotation. Although removed from seal means 35, the lower portion of member 11 is maintained concentrically within member 12 by means of a bearing 36 carried on the lower inwardly enlarged portion of member 12. As best shown in FIG. 3C, vertical slots 36A are formed in the inner diameter of the bearing so as to permit fluid to flow therepast during reciprocation of members 11 and 12.

Of course, when the member 11 is raised to a position for opening the by-pass, there is no pressure differential across the tool, and thus no particular difficulty in lowering it toward retracted position. However, when member 11 is lowered to a position in which its lower end enters seal means 35, further lowering thereof to close the by-pass within seal means 35 is opposed by the pump out effect due to the force resulting from drilling fluid acting over the effective cross section area of member 11 slidable within seal means 36. However, since the upper chamber C-1 is closed at all times except for its fluid connection through port 37 to the interior of member 11, and thus the inside of the by-pass tool, high pressure drilling fluid also acts on the effective pressure area on inner member 11 within the upper chamber, which is defined by the annular area between the inner diameter of seal means 34 and outer diameter of seal means 33, so as to urge the inner member downwardly toward retracted position with a force which opposes the pump out effect.

More particularly, the seal means 33 and 34, as well as the surfaces of the members 11 and 12 with which they engage, are of such size that the volume of chamber C-1 increases and decreases to the same extent as the volume within the remainder of the tool decreases and increases, respectively, during reciprocation of the members. Thus, since the surfaces of the members with which the seal means engage are cylindrical in shape, the effective annular area of the inner member within the upper chamber over which the drilling fluid is effective is substantially equal to the effective area of the lower end of the inner member slidable within seal means 35.

As indicated diagrammatically in FIG. 1B, a float valve 40 is disposed in the upper end of housing 16 of turbine motor 14 so as to normally close the housing to flow in an upward direction, but to permit flow in a downward direction. Thus, as will be explained below, this valve prevents debris from circulating upwardly through the turbine blades 18 and 19 as the drill string is being lowered into the well bore. Then, of course, when the drill string is lowered to dispose bit 15 in drilling position, circulation of drilling mud downwardly through the drill string, including by-pass tool 10, will force valve 40 to open position and thereby permit the drilling fluid to pass downwardly through the turbine motor for rotating the bit. Valve 40 may be of conventional construction such as that shown and described on page 316 of the 1974–75 *Composite Catalog of Oilfield Equipment and Services.*

When closed in this manner, the inside of the drill string must be filled with drilling fluid to prevent its collapse due to the hydrostatic pressure of the drilling fluid in the annulus of the well bore. Thus, it's the practice to fill the drill string above the float valve with drilling mud at the surface level as the joints of pipe are made up and lowered into the well bore. This, however, is a slow and expensive procedure which is obviated by by-pass tool 10 since tool is in extended position, as the drill string is lowered, so as to open the by-pass above float valve 40 and thereby permit drilling fluid to circulate from the annulus into the tool and thus fill it up as the drill string is made up and lowered into the well bore. Preferably, a screen 41 is disposed over the outer end of port 38A in the outer member 12 so as to prevent large particles of debris from moving into and clogging the port or other internal parts of the by-pass tool.

As also shown in the preferred embodiment of the invention, there is a port 42 in the enlarged upper end of tubular member 12 of the by-pass tool which is normally closed by means of a sleeve 43. The sleeve is releasably held in port-closing position by means of a shear pin 44, and carries seal rings 45 and 46 for sealing about the inner diameter of the enlarged portion of member 11 above and below the port 42. The sleeve has an upwardly facing seat onto which a ball (not shown) may be dropped so as to close the bore through it, whereby fluid in the drill string above the ball may be pressurized to shear the pin 44 and move sleeve 43 downwardly until it seats upon an upwardly facing shoulder 47 within member 11. This opens the side port 42 so as to permit circulation therethrough if it is desired, for example, to circulate a large volume of coarse lost circulation material into the annulus of the well bore.

As shown, inner tubular member 11 is made up of three tubular sections, including an upper section 11A having an enlarged upper end through which port 42 is formed and on the lower end of which shoulder 29 is disposed. Splines 27 are formed in section 11A beneath its upper enlarged end, and port 37 is formed in the lower end thereof just above its threaded connection to an outwardly enlarged portion on the upper end of a section 11B which fits closely within the inner diameter of outer member 12. Seal means 33 is carried on section 11B beneath the enlarged portion thereof and just above the threaded connection of its lower end to the upper end of a lower section 11C. Beneath its threaded connection to section 11B, the outer diameter of section 11C is reduced for sliding in the bearing 36 on the member 12, and, in the lowered position of member 11, for sliding within seal means 33.

The outer member 12 is made up of a series of vertically arranged sections, including an uppermost section 12A having shoulder 30 formed on its upper end and splines 28 formed on its inner diameter above the threaded connection of its lower end to a section 12B. Port 38 is formed in section 12B and seal means 34 is carried on the inner diameter thereof just above the threaded connection of its lower end to an intermediate section 12C. The latter section has a reduced inner diameter to provide the upper inwardly enlarged portion of member 12 which fits closely about section 11A of the inner member. More particularly, shoulder 31 is formed on the lower end of section 12C in position to engage the upwardly facing shoulder 32 formed on the upper end of section 11C of the inner member when the inner member is raised to extended position.

The lower end of intermediate section 12C is threadedly connected to the next lower section 12D of member 12 which is slidably engaged by seal means 33. The lower end of section 12D is threadedly connected to the next lower section 12E, which is of reduced inner diameter to provide the lower inwardly enlarged portion of member 12, which supports bearing 36 for disposal about the reduced outer diameter portion of inner member section 11C. Port 38A is also formed in section 12E beneath bearing 36, and screen 41 is secured thereto across an annular recess about the outer end of port 38A. The lower end of section 12E is in turn connected to lowermost section 12F whose lower end provides the box for threaded connection to the pin on the upper end of turbine section housing 16.

Seal means 35 comprises a metal support ring held between the upper end of section 12F and a shoulder about the inner diameter of section 12E, and a series of vertically spaced seal rings carried by the ring in position to form a sliding seal with the reduced outer diameter portion of inner tubular member 11C. As will be appreciated, seal means 35 may thus be installed upon removal of section 12F. Each of the seal means 33 and 34 comprises Chevron packing which is removably held in place on its respective tubular member by means of snap rings, and which may be installed in an obvious manner upon make up of the section of tubular members 11 and 12.

Operation of the above-described tool will be obvious from the foregoing. Thus, as the drill string is lowered into the well bore, members 11 and 12 are extended to open the by-pass, whereby drilling fluid in the annulus of the well bore will flow into the drill string above float valve 40. When the bit 15 has been lowered onto the bottom of the well bore, continued lowering of the drill string will lower member 11 of the by-pass tool toward retracted position. During the initial stage of this downward movement, the by-pass is open so that there is no pump out effect opposing it.

When the lower end of member 11 first enters the seal means 35 so as to close the by-pass, the force due to the pump out effect is opposed by a substantially equal force due to the pressure of drilling fluid within the tool acting over the effective pressure area of member 11 within chamber C-1. Consequently, it is possible to continue to move the inner member downwardly with little or no resistance, and thus to a retracted position for transmitting downward force through the drill string to the bit 15. At this time, drilling mud may be circulated downwardly through the string; and, since the by-pass is closed, all of it passes through the turbine section of motor 14 to rotate the bit.

On the other hand, when it is desired to open the by-pass, for any number of reasons, such as those previously mentioned, it is merely necessary to lift the drill string so as to remove the lower end of member 11 from within seal means 35. This, of course, opens the by-pass so that the resistance to flow through the turbine section due to the turbine blades 18 and 19 will cause most of the drilling fluid to be diverted outwardly into annulus, so that there is insufficient flow through the turbine section for causing the bit to rotate with enough speed and thrust load as to damage it. When the drill string is to be raised from the well bore, member 11 need only be lifted to its fully extended position to cause shoulder 31 to engage shoulder 32 so as to lift outer member 12 and the turbine motor 14 therewith.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A tool for connection as a part of a pipe string which is adapted to be disposed within a well bore, comprising a first tubular member, a second tubular member arranged concentrically within the first member to provide an annular space therebetween, said tubular members being longitudinally reciprocable with respect to one another between extended and retracted positions, first means carried by the second member for sealably engaging the first member, second means carried by the first member for sealably engaging the second member to define a first annular chamber between the first and second sealing means, a first port in the second member connecting the interior of the second member with the first chamber, third means for sealably engaging between the first and second members to define a second annular chamber between the first and third sealing means when said pipe string is lowered to move said tubular members to retracted position, and a second port in the first member connecting the second chamber with the exterior of the tool, said second member having an opening therein which connects the interior of said second member with said second chamber when the pipe string is raised to move said members to extended position, so as to permit drilling fluid to flow through said second chamber and out said second port and thereby by-pass the portion of the pipe string below said tool.

2. A tool of the character defined in claim 1, wherein the volume of the first chamber increases and decreases, during reciprocation of said members, in an amount substantially equal to the decrease and increase, respectively, of the remainder of the interior of the tool.

3. A tool of the character defined in claim 1, wherein the opening in the second member is in its lower end.

4. A tool of the character defined in claim 3, wherein the third means is carried by the first member for sealably engaging about the second member when said members are moved to retracted position.

5. A tool of the character defined in claim 1, including a screen across the outer side of second port.

* * * * *